United States Patent [19]

Fischer

[11] 4,359,249

[45] Nov. 16, 1982

[54] DISPLAY CASE AND A MODULAR DISPLAY CASE SYSTEM

[75] Inventor: Klaus Fischer, Niederdorfelden, Fed. Rep. of Germany

[73] Assignee: Glasbau Heinrich Hahn GmbH & Co. KG, Frankfurt am Main, Fed. Rep. of Germany

[21] Appl. No.: 166,850

[22] Filed: Jul. 8, 1980

[51] Int. Cl.[3] ..... A47B 53/00; A47B 87/00

[52] U.S. Cl. ..... 312/198; 312/114; 312/140

[58] Field of Search ..... 312/198, 140, 114, 206, 312/125, 118, 199, 200

[56] References Cited

U.S. PATENT DOCUMENTS

| | | | |
|---|---|---|---|
| 694,987 | 3/1902 | Pollard | 312/114 |
| 712,842 | 11/1902 | Paulle | 312/140 |
| 1,230,825 | 6/1917 | Arnold | 312/140 |
| 1,981,710 | 11/1934 | Rix | 312/140 |
| 2,023,260 | 12/1935 | Beers et al. | 312/140 |
| 3,228,736 | 1/1966 | Beckerman | 312/114 |
| 3,353,888 | 11/1967 | Pritelli, Jr. | 312/140 |
| 3,697,147 | 10/1972 | Schulte | 312/114 |
| 3,791,091 | 2/1974 | Albrizzi | 312/140 |
| 3,814,489 | 6/1974 | Clark et al. | 312/140 |
| 4,124,958 | 11/1978 | Chiche | 312/140 |

FOREIGN PATENT DOCUMENTS

| | | |
|---|---|---|
| 710889 | 8/1941 | Fed. Rep. of Germany . |
| 1554233 | 1/1972 | Fed. Rep. of Germany . |
| 1561616 | 12/1972 | Fed. Rep. of Germany . |
| 2541185 | 3/1977 | Fed. Rep. of Germany . |

*Primary Examiner*—Victor N. Sakran
*Attorney, Agent, or Firm*—Robert Scobey

[57] ABSTRACT

A display case being rectangular in a plan elevation, characterized by side walls and a door, each consisting of a glass panel (3,4,5,6) of equal thickness having side edges abutting at each other and having fastening means (16,17), some of them being fastened to an upper and a lower frame (1,2) respectively, the outer surfaces of the upper and lower frames (1,2) ending at a distance from the outer surfaces of the glass panels which distance is at least half of the thickness (25) of one of the glass panels, each one of the glass panels at one end abutting with its inner surface at the end face (21) of the neighboring glass panel, and at its other end (22) abutting with its end face (26) at the inner surface of the glass panel neighboring that other end, and that the fastening means (16,17) of the glass panels (3,4,5,6) are not protruding over the outer surface of their glass panel.

There also is described a modular display system consisting of several such display cases.

4 Claims, 3 Drawing Figures

25
8
26
22
5
7
16
20
21
8
7
17
4
7
6
16
120
121
19
120
121
19
121
121
24
8
123
16
122
3
7
123
8

DISPLAY CASE AND A MODULAR DISPLAY CASE SYSTEM

DESCRIPTION

This invention is concerned with a display case and additionally with a modular display case system.

PRIOR ART

German Auslegeschrift 1,561,616 is describing a display case being rectangular in a plan elevation and having side walls consisting of glass panels only. These glass panels are attached to each other by fastening means provided at the corners and edges of the glass panels. These fastening means are protruding over the outer surfaces of the glass panels. Therefore, when putting several such display cases together there always remains a distance between the glass panels of the display cases and, therefore, also between the display cases themselves, which distance is due to the fastening means protruding over the glass panels. The minimum distance between two such display cases is twice the thickness of these fastening means protruding over its glass panels. Another disadvantage of this known display case is that for the reasons pointed out it is not possible to put several such display cases rectangularily together and still be in a rectangular raster.

German Offenlegungsschrift 2,541,185 is showing a shelf system with wooden panels, the edges of the wooden panels being mitered. Using this principle of panels with mitered joints, theoretically it will be possible to construct a display case system in a raster, each display case being constructed without posts at the corners of its vertical edges or without fastening means protruding over the glass panels. However, using the principle of panels with mitered edges for constructing a display case, this will create problems in giving to the glass panels such mitered edges. Such glass panels with mitered edges, namely, will chip at the mitered edges when being closely put together to form such a display case. In this connection it is also to be considered that such a display case must have at least one movable glass panel to have an access to the interior of the display case. The danger of splintering will be even greater with this movable door. Moreover, the vertical mitered edges of the display case will be much more visible than normal, rectangular edges of the glass panels. Finally, it is expensive to make glass panels with mitered edges with the high precision necessary for such a display case. Therefore, the solution proposed in this Offenlegungsschrift cannot be used to construct a display case consisting of glass panels only as side walls.

OBJECT OF THE INVENTION

It is an object of the invention to propose a display case being rectangular in a plan elevation such, that there is provided a lower and an upper frame of the display case and the side walls including a door of the display case being constructed of glass panels only.

Another object of the invention is to provide several of these display cases which can be put together without a gap.

Another object of the invention is to provide a modular display case system which can be erected in a raster.

SUMMERY OF THE INVENTION

The invention consists of a display case being rectangular in a plan elevation characterized by side walls and a door, each consisting of a glass panel of equal thickness, having side edges abutting at each other and having fastening means, some of them being fastened to an upper and a lower frame, respectively, the outer surfaces of the upper and lower frames ending at a distance from the outer surfaces of the glass panels, which distance is at least half of the thickness of one of the glass panels, each one of the glass panels at one end abutting with its inner surface at the end face of the neighbouring glass panel and at its other end abutting with its end face at the inner surface of the glass panels neighbouring that other end, and that the fastening means of the glass panels are not protruding over the outer surface of their glass panel.

By these means it is possible to construct an all glass display case meaning that the four side walls of the display case only are consisting of glass without any vertical posts, or the like. As both upper and lower frames are behind the outer surfaces of the glass panels, it is possible to make a display case with three glass panels and either to close the fourth open side with a fourth glass panel being a door, or to extend those two glass panels which are open at one end such that there is constructed a rectangular display case covering a larger area. This extension can be made in one direction or also in a direction perpendicular to this one direction. The larger display case being constructed in this way finally must be closed by at least one door. All these extensions still remain in the same raster. The glass panels effecting the extensions either are having the same length as the glass panels of the basic display case, or they have a length which is several times the length of the basic glass panels. Because the fastening means are not protruding over the glass panels in a plan elevation, it is possible to make these extensions and still remain in the raster. This also is the reason for the claimed kind in which the glass panels are abutting each other and for said receding of the frames behind the outer surfaces of the glass panels.

A simple means for keeping the fastening means within the profile of the glass panels is that the fastening means in a vertical section have an L-profile, the glass panels being fastened to the recess of the L-profile of the fastening means. The fixing of the glass panels to the fastening means preferably is done by gluing, because then no screws or bolts are protruding over the outer surfaces of the glass panels. However, such bolting connections also are possible provided the bolting means do not protrude over the outer surfaces of the glass panels.

The fastening means themselves are fastened in an appropriate way to the upper and lower frames, respectively, e.g. using bolts as fastening means. However, the fastening means also can be glued to the frames.

One of the glass panels has to be movable to have an access to the interior of the display case, In this connection it is preferred that fittings for movably holding that glass panel which is serving as a door are allowing a movement of that glass panel in a direction vertical to its plane and in its plane. With such fittings, there is no danger that the vertical edges of this glass panel serving as a door will contact the edges of the neighbouring glass panels. A fitting which is allowing such a movement is described in German Auslegeschrift 1 554 233 and will be described afterwards in detail.

As explained above, the claimed display case can be used to construct a modular display system having side walls consisting of glass panels only and being constructed in a raster.

DESCRIPTION OF PREFERRED EMBODIMENTS

The invention now will be further described having regard to preferred embodiments for explaining further objects and advantages of the claimed invention.

Figure 1:
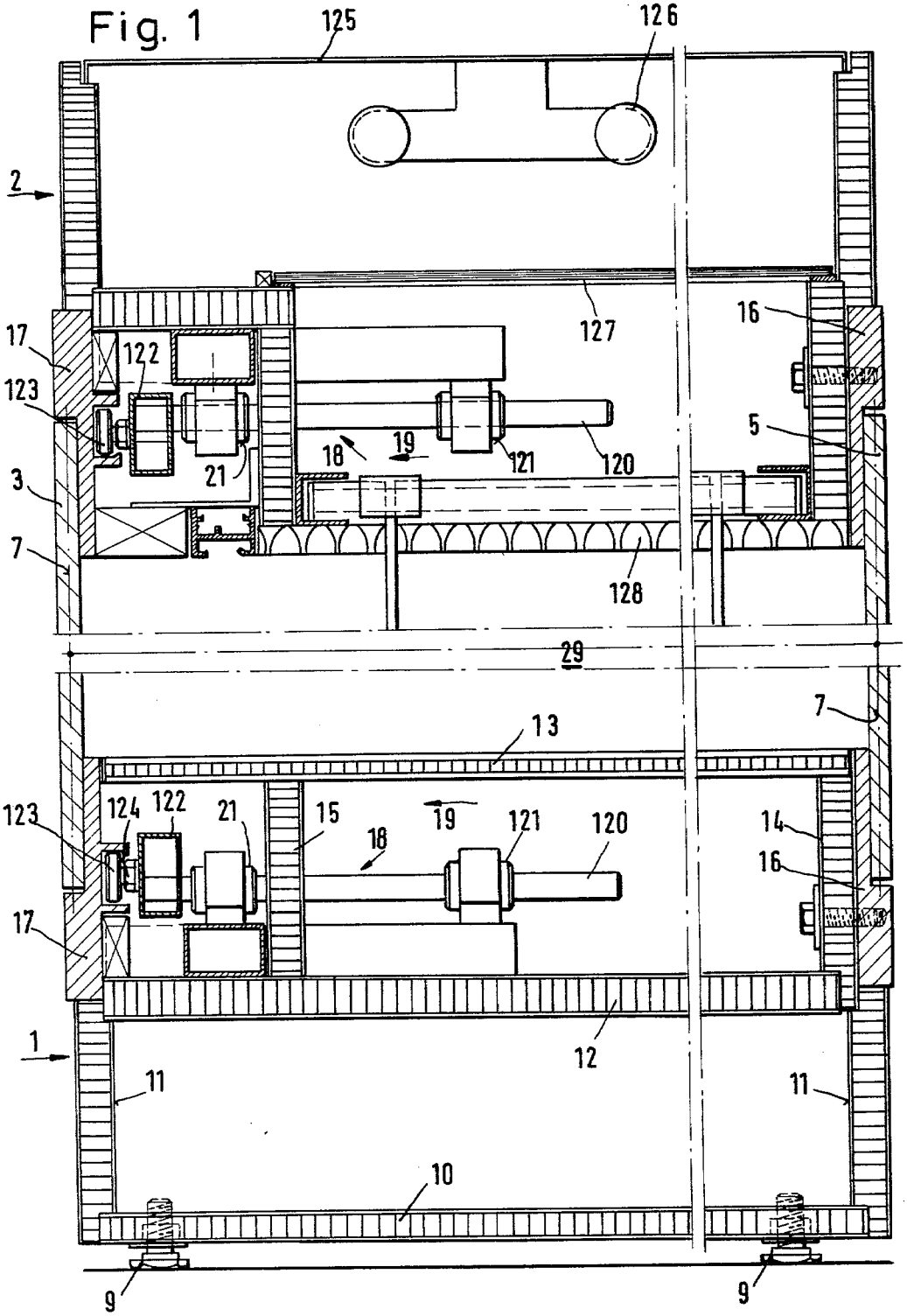
FIG. 1 is a vertical section through a display case of the invention.
Figure 2:
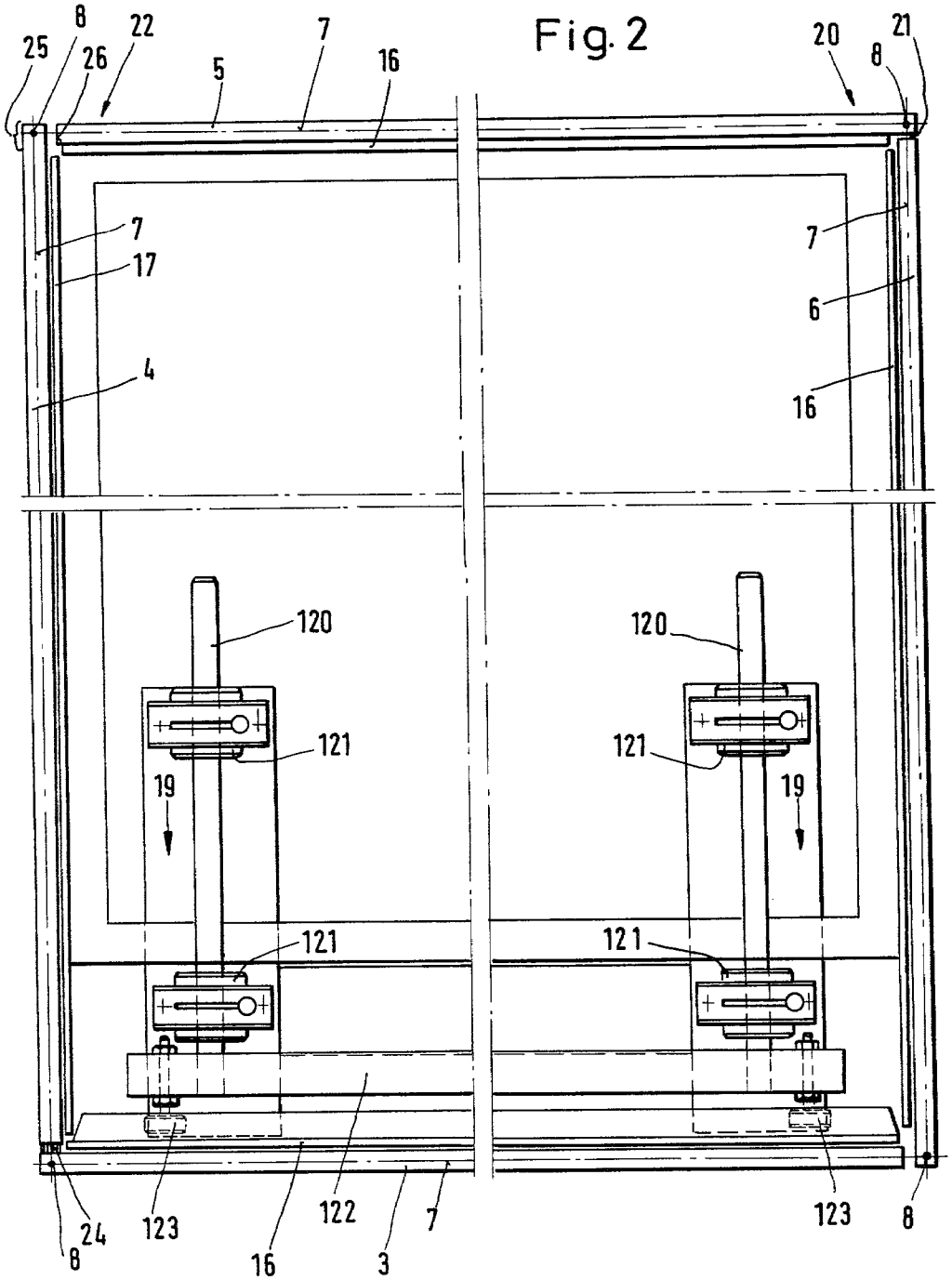
FIG. 2 is a plan elevation of the display case of FIG. 1 without the upper frame shown in FIG. 1.
Figure 3:
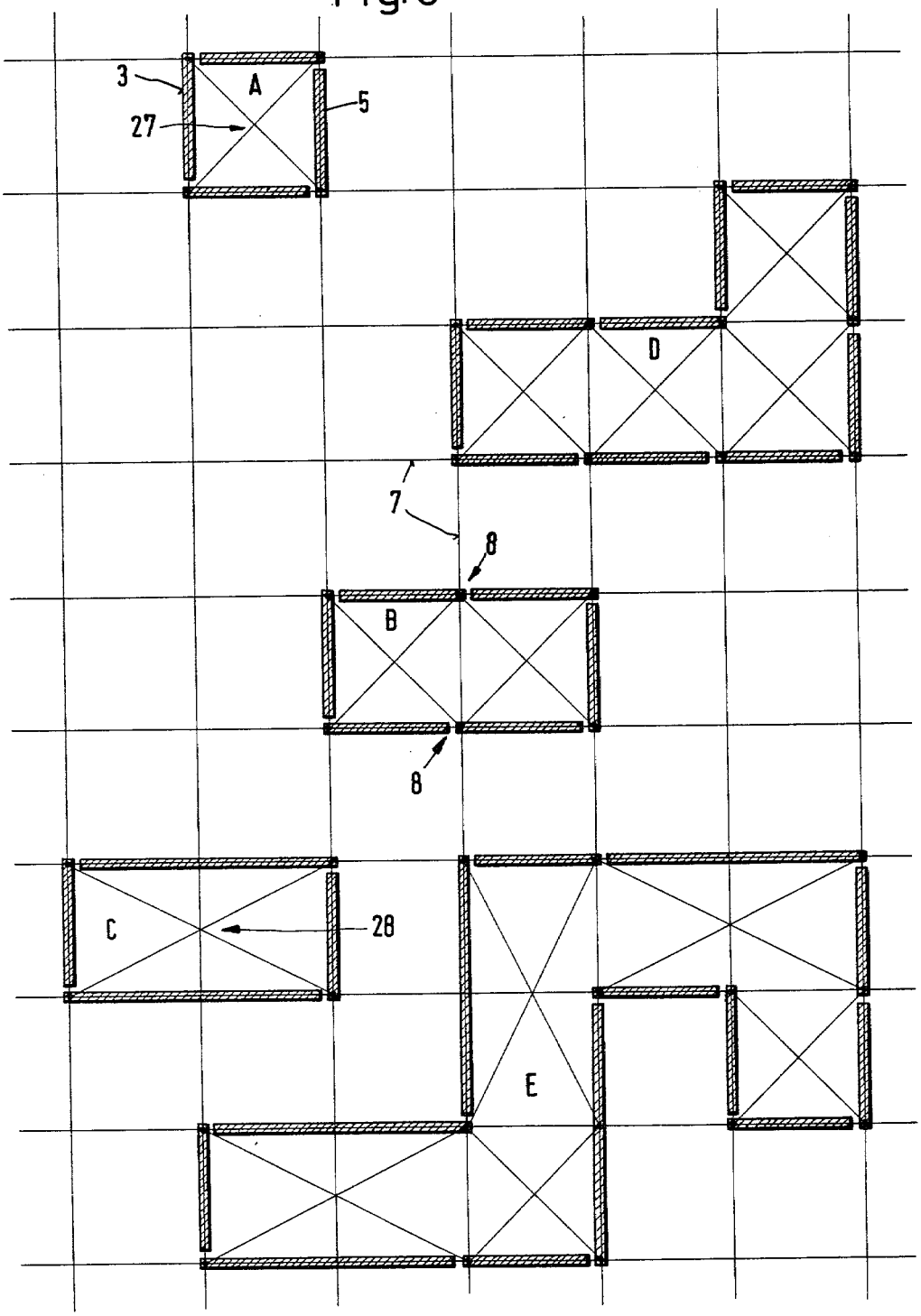

FIG. 3 schematically is showing the display case of FIGS. 1 and 2 and additionally several examples of a modular display system using the construction principle of the display case of FIGS. 1 and 2.

The basic construction principle of a quadratic display case first of all will be described having regard to FIGS. 1 and 2. The display case as shown basically is consisting of a lower frame 1, a lighted upper frame 2 and four glass panels 3, 4, 5, 6. The median lines of these glass panels are shown as Position No. 7. The shown display case in a plan elevation is quadratic, as shown in FIG. 2. The sections of the median lines 7 are corner points 8 of a quadratic raster which is shown in FIG. 3. The display case is constructed within this quadratic raster.

Feet 9 are provided which are adjustable in its height and which are fastened to a bottom plate 10 of the lower frame 1. This lower frame 1 is constructed of bottom plate 10 and four side walls 11. Additionally, there are provided intermediate bottom plates 12, 13, the upper intermediate bottom plate 13 closing the upper side of the lower frame 1. The intermediate bottom plates 12 and 13 are connected to each other by walls 14 and 15.

Fastened to the back wall 14 is a fastening means 16 having L-profile. This fastening is done by bolts as shown. Another fastening means 17, also being L-profiled, is provided, this fastening means 17 being connected to the front glass panel 3. This fastening means 17 is connected such to the lower frame 1 that it can be moved as explained in more detail below.

Fastening means 16 moreover are provided at the two side walls which cannot be seen in FIG. 1. Also, these fastening means 16 are fastened to the lower frame 1. Identical fastening means 16 and 17 are provided at the upper frames 2 such that the three glass panels 4, 5, 6 are non-movable side walls of the display case and the front glass panel 3 can be moved and is serving as a door for having access to the display case.

The glass panels 3, 4, 5, 6 are inserted into the recesses of the fastening means and are glued to the fastening means 16 and 17, respectively.

Between the intermediate bottom plates 12 and 13 there is provided a door fitting 18. This door fitting is allowing the front glass panel 3 to move such that it can serve as a movable door. The movement of this front glass panel 3 is such that it can be moved in the direction of the arrow 19 and in the reverse direction of this arrow. This is a direction perpendicular to the plane of the front glass panel 3. Additionally, the door fitting 18 is allowing a movement of the front glass panel 3 in its plane.

For allowing these movements there are provided bars 120 which are slidably positioned in sleeves 121 such that the bars 120 can be moved in the direction of arrow 19 and in its reverse direction. Profiled tubes 122 are provided perpendicularly to the bars 120 and are connecting two such door fittings 18 to each other. Several rollers 123 are connected to the tubes 122 by means of bars 124. The rollers are sliding in profiles of the fastening means 17 and are, therefore, allowing a movement of the front glass panel 3 in a plane paralleling the plate of that front glass panel 3. The same door fitting 18 having the same movement characteristics is provided at the upper frame 2.

At the upper frame 2, there also is provided a non-transparent cover plate 125 to which is fastened a lamp means 126. The light of this lamp means is going through a glass plate 127 and a light scattering grid 128 into the interior 29 of the display case.

It can be taken from FIG. 1 that none of the fastening means 16 and 17 is protruding over the outside of the glass panels. The outer surfaces of the frames 1 and 2 are provided in the planes of the median lines 7 of the glass panels.

FIG. 2 is showing that every glass panel 3, 4, 5, 6 is abutting with one of its ends 20 with its inner surface at the end face 21 of the glass panel neighbouring said end of said first glass panel. This is shown in FIG. 2 at the upper right corner with the glass panels 5 and 6. The other end 22 of this glass panel 5 is abutting with its end face 26 to the inner surface of the glass panel 4 neighbouring this glass panel 5 at its other end 22.

Every glass panel might have at its vertical end faces a sealing 24 consisting of a brushing, only one of these brushings 24 being shown in FIG. 2.

It can be taken from FIGS. 2 and 3 that such display cases having a quadratic plan elevation and defining a raster which itself is defined by the corner points 8, voluntarily can be adjoined to each other forming a modular display system. When making such a display system this can be done in the raster without using any vertical posts of metal. FIG. 3 is showing the display case of FIGS. 1 and 2 at Position No. 27 as basic example A of such a modular display system.

It can be taken from FIG. 3 that the display cases constructed of the basic conception of the display case 27 must not be quadratic. They can be rectangular and having any profile remaining in the raster, e.g. a L, T, U, E and H-profile. FIG. 3 is showing some examples of these different profiles B–E.

The display case B basically is consisting of two display cases A put together where those two glass panels have been omitted which are abutting each other, namely for the right part of case B panel 3 of A has been omitted and for the left part of B panel 5 of A has been omitted, both parts of B having a common median line 7 and two identical points 8.

The display case 28 of the example C has the same rectangular configuration of example B. In example C, however, there are provided two glass panels having twice the length of the glass panels of the basic display case A.

The frames 1 and 2 either are quadratic as with example A, or they are in a different profile which is to be constructed in a special case.

It is also possible to put two display cases together such that they only have common one corner point 8.

Additionally it is possible to have a vertically extending separating glass panel within the display case. This separating panel is shorter by the thickness 25 of the glass panels 3, 4, 5, 6 to be inserted between two such panels, e.g. between the glass panels 4 and 6 of FIG. 2.

FIG. 1 is showing that the fastening means 16 and 17 are flushing with the outer surfaces of the glass panels.

This is for protecting the upper and lower edges of the glass panels. However, the fastening means 16 and 17 also can flush with the outer surface of the frames 1 and 2, or even further go back into the interior of the display case.

D and E of FIG. 3 are further examples of possible configuration of a display case constructed according to the explained construction principles.

I claim:

1. In a display case which is generally rectangular in plan elevation, and which has glass panels constituting side walls and a door, and upper and lower frames for supporting the glass panels, the improvement in which the glass panels are supported by the upper and lower frames so that the outer surfaces of the glass panels constitute the outermost surfaces of the display case, wherein the outermost surfaces of the upper and lower frames are inside the planes of the outer surfaces of the glass panels by a distance at least half of the thickness of said glass panels, and wherein each of said glass panels at one end thereof abuts with its inner surface at the end face of the adjacent glass panel, and at its other end abuts with its end face at the inner surface of the glass panel adjacent to said other end.

2. A display case according to claim 1, including fastening elements each being L-shaped in vertical section for holding the glass panels and securing them to said frames.

3. A display case according to claim 2, including fittings for supporting a glass panel serving as a door and providing for movement of that glass panel in a direction perpendicular to the plane of that panel.

4. A modular display system composed of several display cases each according to any one of claims 1 to 3.

* * * * *